US007284806B2

(12) United States Patent
Nakamura

(10) Patent No.: US 7,284,806 B2
(45) Date of Patent: Oct. 23, 2007

(54) INK-JET RECORDING APPARATUS AND METHOD OF INTRODUCING INK IN THE SAME

(75) Inventor: Hirotake Nakamura, Nagoya (JP)

(73) Assignee: Brother Kogyo Kabushiki Kaisha, Nagoya-shi (JP)

( * ) Notice: Subject to any disclaimer, the term of this patent is extended or adjusted under 35 U.S.C. 154(b) by 194 days.

(21) Appl. No.: 10/721,304

(22) Filed: Nov. 25, 2003

(65) Prior Publication Data

US 2004/0104950 A1 Jun. 3, 2004

(30) Foreign Application Priority Data

Nov. 28, 2002 (JP) ..... 2002-345004

(51) Int. Cl.
*B41J 29/38* (2006.01)

(52) U.S. Cl. ..... 347/6

(58) Field of Classification Search ..... 347/86, 347/214, 92, 93, 6

See application file for complete search history.

(56) References Cited

U.S. PATENT DOCUMENTS

| | | | | |
|---|---|---|---|---|
| 4,970,533 | A * | 11/1990 | Saito et al. | 347/86 |
| 6,059,405 | A * | 5/2000 | Mochizuki et al. | 347/92 |
| 6,231,174 | B1 | 5/2001 | Haigo | |
| 6,286,934 | B1 * | 9/2001 | Sakanobe et al. | 347/49 |
| 6,312,115 | B1 | 11/2001 | Hara et al. | |
| 6,837,577 | B1 * | 1/2005 | Anderson et al. | 347/85 |
| 6,854,834 | B2 | 2/2005 | Hara et al. | |
| 6,929,359 | B2 | 8/2005 | Hara et al. | |
| 7,086,723 | B2 | 8/2006 | Hara et al. | |
| 2001/0017642 | A1 | 8/2001 | Shigemura | |
| 2002/0191056 | A1 * | 12/2002 | Ardito | 347/86 |
| 2004/0134801 | A1 * | 7/2004 | Shimizu et al. | 206/213.1 |

FOREIGN PATENT DOCUMENTS

| | | | |
|---|---|---|---|
| EP | 0 823 329 | A2 | 2/1998 |
| JP | 60-174652 | A | 9/1985 |
| JP | 61141560 | A * | 6/1986 |
| JP | 61-286141 | A | 12/1986 |
| JP | 3 61592 | | 9/1991 |
| JP | 10-250104 | A | 9/1998 |
| JP | 2001 260389 | | 9/2001 |

* cited by examiner

*Primary Examiner*—Stephen Meier
*Assistant Examiner*—Jason Uhlenhake
(74) *Attorney, Agent, or Firm*—Day Pitney

(57) ABSTRACT

A method of introducing ink in an ink-jet recording apparatus including an ink-jet printing head which ejects, to a recording medium, the ink through nozzles thereof, the method including the steps of a first ink-introducing step of initially introducing a first ink into the ink-jet printing head when the ink-jet printing head is initially used, the first ink having a first degree of deaeration; and a second ink-introducing step of subsequently introducing a second ink into the ink-jet printing head after the first ink-introducing step, the second ink having a second degree of deaeration, which is lower than the first degree of deaeration.

13 Claims, 9 Drawing Sheets

INK-JET RECORDING APPARATUS AND METHOD OF INTRODUCING INK IN THE SAME

The present application is based on Japanese Patent Application No. 2002-345004 filed Nov. 28, 2002, the contents of which are incorporated herein by reference.

BACKGROUND OF THE INVENTION

1. Field of the Invention

The present invention relates in general to an ink-jet recording apparatus and a method of introducing ink accommodated in an ink package in the ink-jet recording apparatus. In particular, the present invention relates to such an apparatus capable of ejecting or delivering, with high stability, the ink accommodated in the ink package and a method of introducing the ink to the ink-jet recording apparatus with high stability, while reducing a cost required for packing or enclosing the ink package.

2. Discussion of Related Art

There is known an ink-jet recording apparatus which comprises an ink-jet printing head having nozzles through which ink is ejected to a recording medium, a mounting portion on which an ink package that accommodates the ink is removably mounted, and an ink-introducing device by which the ink accommodated in the ink package is introduced into the ink-jet printing head.

The ink used for the ink-jet recording apparatus is manufactured by a process including a step of dissolving an ink material in a solvent, and a step of filtering a solution of the ink material. Where the ink as manufactured by this process is accommodated in the ink package for use on the ink-jet recording apparatus, various kinds of gasses such as nitrogen, oxygen and carbon dioxide that are dissolved in the ink are introduced together with the ink into the ink-jet printing head, causing bubbles that may prevent the ink-jet printing head from smoothly ejecting droplets of the ink, giving rise to a risk of a poor ink-ejecting performance of the head. To avoid this drawback, it has been practiced to carry out a deaerating or degassing treatment of the ink, so as to reduce the amounts of the dissolved gases before the ink is accommodated in the ink package. This deaerating treatment involves an operation to stir the ink within a pressure vessel at a reduced pressure and an operation using a deaerating device equipped with a gas permeation membrane.

When the ink package in which the thus deaerated or degassed ink is accommodated is transported, or stored for a long time before its use, oxygen and other gases in the air may be dissolved in the ink. JP-B2-3-61592 (column 4, lines 4-7, and FIG. 1, in particular) discloses a technique to prevent the dissolution of such gases in the ink. According to this technique, an ink bag filled with the degassed ink is accommodated in a suitable ink-bag casing, and this ink-bag casing is placed in a vacuum chamber the pressure of which is adjusted to a reduced pressure lower than the atmospheric level, and is fluid-tightly enclosed or accommodated within a sealing wrapper or container such as a plastic or rubber bag or a metallic can or box, so that the casing is kept under the reduced pressure in the evacuated sealing wrapper, during transportation or storage.

To prevent a poor ink-ejecting performance of the ink-jet recording apparatus, the ink used for the apparatus is required to maintain a high degree or deaeration, as described above. Where all of the ink packages, including those for replacement, to be used on the ink-jet recording apparatus are packed or enclosed according to the above-indicated technique disclosed in JP-B2-3-61592, the cost required for packing or enclosing the ink package is inevitably increased, resulting in an increase in the running cost of the ink-jet recording apparatus.

The inventor of the present invention conducted experiments and found the following: The ink-ejecting performance of the ink-jet recording apparatus is largely influenced by the degree of deaeration of the ink in a case where the ink is initially introduced into the ink-jet printing head of the apparatus when the ink-jet printing head is initially used. As long as the ink having a relatively high degree of deaeration is introduced when the ink-jet printing head is initially used, the ink-ejecting performance of the apparatus is not largely influenced by the degree of deaeration of the ink even if the ink which is to be subsequently introduced into the ink-jet printing head has a degree of deaeration lower than that of the initially introduced ink.

SUMMARY OF THE INVENTION

It is therefore a first object of the present invention to provide a method of introducing ink, with high stability, in an ink-jet recording apparatus while reducing a cost required for packing or enclosing an ink package which accommodates the ink.

It is a second object of the present invention to provide an ink-jet recording apparatus capable of ejecting, with high stability ink accommodated in an ink package while reducing a cost for required for packing or enclosing an ink package which accommodates the ink.

The first object indicated above may be achieved according to a first aspect of the present invention, which provides a method of introducing ink in an ink-jet recording apparatus comprising an ink-jet printing head which ejects, to a recording medium, the ink through nozzles thereof, the method comprising the steps of a first ink-introducing step of initially introducing a first ink into the ink-jet printing head when the ink-jet printing head is initially used, the first ink having a first degree of deaeration; and a second ink-introducing step of subsequently introducing a second ink into the ink-jet printing head after the first ink-introducing step, the second ink having a second degree of deaeration, which is lower than the first degree of deaeration.

In the above-described method according to the first aspect of the present invention, the first ink which is initially introduced into the ink-jet printing head in the first ink-introducing step when the ink-jet printing head is initially used has a first degree of deaeration that is higher than a second degree of the second ink which is subsequently introduced into the ink-jet printing head in the second ink-introducing step. In the present method, where the ink is initially introduced into the ink-jet printing head when the ink-jet printing head is initially used, the first ink having a higher degree of deaeration is initially used, whereby the ink is introduced into the ink-jet printing head without being bubbled in the ink-jet printing head. Further, the second ink which is subsequently introduced into the ink-jet printing head in the second ink-introducing step is prevented from being bubbled even if its degree of deaeration is not as high as, namely, lower than, the degree of deaeration of the initially introduced first ink. Therefore, even if the second ink has the degree of deaeration lower than that of the first ink, the second ink can be introduced into the ink-jet printing head with high stability, resulting in good or stable ink-ejecting performance of the ink-jet printing head. Unlike a conventional method wherein the ink with a relatively high deaeration degree has been always used, the present method is effective to reduce the cost of the ink to be used, and assures a stable ink-ejecting performance of the ink-jet recording apparatus.

In one preferred form of the method according to the first aspect of the present invention, the ink-jet recording apparatus further comprises a mounting portion on which an ink package accommodating the ink is removably mounted and an ink-introducing device which introduces, into the ink-jet printing head, the ink accommodated in the ink package that is mounted on the mounting portion; and wherein the first ink-introducing step comprises (a) mounting, as the ink package, an initial-use ink package accommodating the first ink, on the mounting portion and (b) introducing the first ink into the ink-jet printing head by the ink-introducing device; and wherein the second ink-introducing step comprises (a) mounting, as the ink package, a replacement ink package accommodating the second ink, on the mounting portion, the replacement ink package replacing the ink package which has been mounted on the mounting portion immediately before the replacement ink package is mounted, and (b) introducing the second ink into the ink-jet printing head by the ink-introducing device; and wherein the initial-use ink package is in a state, before mounting thereof on the mounting portion, in which the initial-use ink package is enclosed such that the first ink in the initial-use ink package maintains the first degree of deaeration which is higher than the second degree of deaeration of the second ink in the replacement ink package.

In the method according to the above-described preferred form of the invention, when the ink package is mounted on the mounting portion of the ink-jet recording apparatus, the ink accommodated in the ink package is introduced into the ink-jet printing head by the introducing device and is ejected from the nozzles of the ink-jet printing head to the recording medium. According to the present method, in the first ink-introducing step, the ink package in the form of the initial-use ink package accommodating the first ink is mounted on the mounting portion and the first ink is introduced into the ink-jet printing head by the introducing device. In the second ink-introducing step, the ink package in the form of the replacement ink package accommodating the second ink is mounted on the mounting portion and the second ink is introduced into the ink-jet printing head by the introducing device. The replacement ink package replaces the ink package which has been mounted on the mounting portion immediately before the replacement ink package is mounted on the mounting portion. The initial-use ink package is in a state, before mounting thereof on the mounting portion, in which the initial-use ink package is enclosed such that the first ink accommodated therein maintains the first degree of deaeration which is higher than the second degree of deaeration of the second ink accommodated in the replacement ink package.

In the above-described form of the method of the invention, the degree of deaeration of the ink which is initially introduced into the ink-jet printing head when the ink-jet printing head is initially used is higher than that of the ink that is subsequently introduced. Where -the ink package that accommodates the ink having a relatively high degree of deaeration is packed or enclosed such that the ink maintains the high deaeration degree, the cost of packing or enclosing the ink package is inevitably increased. According to the present form of the invention, only the initial-use ink package accommodating the first ink that is initially introduced into the ink-jet printing head when the ink-jet printing head is initially used needs to be packed or enclosed for enabling the first ink to maintain its high deaeration degree. Accordingly, the present arrangement is effective to reduce the cost required for packing or enclosing the ink package and accordingly reduce the running cost of the ink-jet recording apparatus.

As described above, the replacement ink package replaces the ink package which has been mounted on the mounting portion immediately before the replacement ink package is mounted. Described more specifically, the replacement ink package may be used immediately after the initial-use ink package has been used, or may be used after a plurality of initial-use ink packages have been used, and the replacement ink package may be replaced with any other kinds of ink packages.

In another preferred form according to the first aspect of the method of the present invention, each of the initial-use ink package and the replacement ink package includes an ink bag whose opposite major surfaces are constituted by a pair of flexible walls, and a rigid ink-bag casing which accommodates the ink bag.

In the above-described preferred from of the invention, each of the first ink and the second ink is accommodated in an ink bag whose opposite surfaces are constituted by a pair of flexible walls, and the ink bag is accommodated in a rigid ink-bag casing. Where the interior space of the sealing wrapper in which the ink package is accommodated is evacuated to a reduced pressure lower than the atmospheric pressure, the atmospheric pressure acting on the ink package through the sealing wrapper is absorbed by the rigid ink-bag casing. Accordingly, the ink bag is prevented from collapsing or tearing due to the atmospheric pressure, for thereby avoiding a leakage flow of the ink from the ink bag. Further, the present arrangement wherein the ink package is constituted by the ink bag and the ink-bag casing assures easy handling as compared in an arrangement wherein an ink package is constituted simply by a bag.

The second object indicated above may be achieved according to a second aspect of the present invention which provides an ink-jet recording apparatus comprising an ink-jet printing head having nozzles through which ink is ejected to a recording medium, an ink package in which the ink that is to be introduced into the ink-jet printing head is accommodated, a mounting portion on which the ink package is removably mounted, and an ink-introducing device which introduces, into the ink-jet printing head, the ink that is accommodated in the ink package mounted on the mounting portion, wherein the ink package comprises an initial-use ink package accommodating a first ink having a first degree of deaeration and a replacement ink package accommodating a second ink having a second degree of deaeration which is lower than the first degree of deaeration, the initial-use ink package and the replacement ink package being selectively mounted on the mounting portion, the initial-use ink package being initially mounted on the mounting portion when the ink-jet printing head is initially used.

In the apparatus according to the second aspect of the invention, the initial-use ink package which is initially mounted on the mounting portion when the ink-jet printing head is initially used accommodates the first ink whose degree of deaeration is higher than that of the second ink accommodated in the replacement ink package which is mounted after the initial-use ink package has been used. In the present apparatus, where the ink is initially introduced into the ink-jet printing head when the ink-jet printing head is initially used, the initial-use ink package accommodating the first ink with a high degree of deaeration is used, so that the ink is introduced into the ink-jet printing head without being bubbled within the ink-jet printing head. Further, the second ink accommodated in the replacement ink package which is introduced after the first ink in the initial-use ink package has been used is prevented from being bubbled in the ink-jet printing head even if its degree of deaeration is not as high as, namely, lower than, the degree of deaeration of the initially introduced first ink. Therefore, even if the second ink has the degree of deaeration lower than that of the first ink, the second ink can be introduced into the ink-jet printing head with high stability, resulting in good or stable ink-ejecting performance of the ink-jet printing head. Unlike a conventional arrangement wherein all of ink packages to be used on the recording apparatus need to be packed or enclosed such that the ink accommodated therein is kept in the highly deaerated state, the present arrangement is effective to reduce the cost required for packing or enclosing the ink package, and assures a stable ink-ejecting performance of the ink-jet recording apparatus.

The apparatus according to the second aspect of the invention may have any one of the features included in the above-described preferred forms of the method according to the above-described first aspect of the invention.

BRIEF DESCRIPTION OF THE DRAWINGS

The above and other objects, features, advantages and technical and industrial significance of the present invention will be better understood by reading the following detailed description of preferred embodiments of the invention, when considered in connection with the accompanying drawings, in which.

DETAILED DESCRIPTION OF THE PREFERRED EMBODIMENTS

Figure 1:
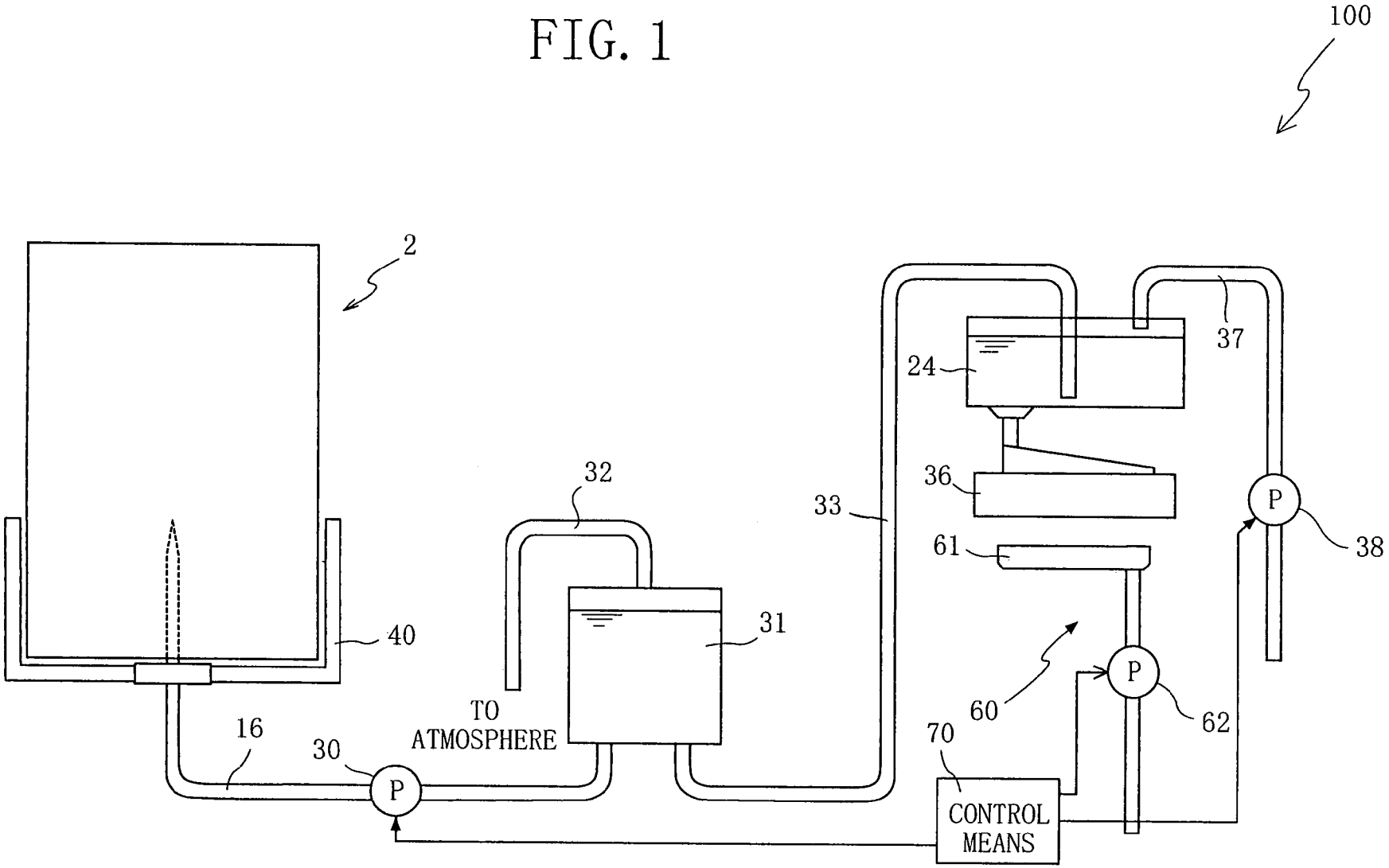
FIG. 1 is a schematic view showing an ink-jet recording apparatus to which the principle of the present invention is applied.

Referring to the drawings, there will be described preferred embodiment of the present invention.

Figure 2:
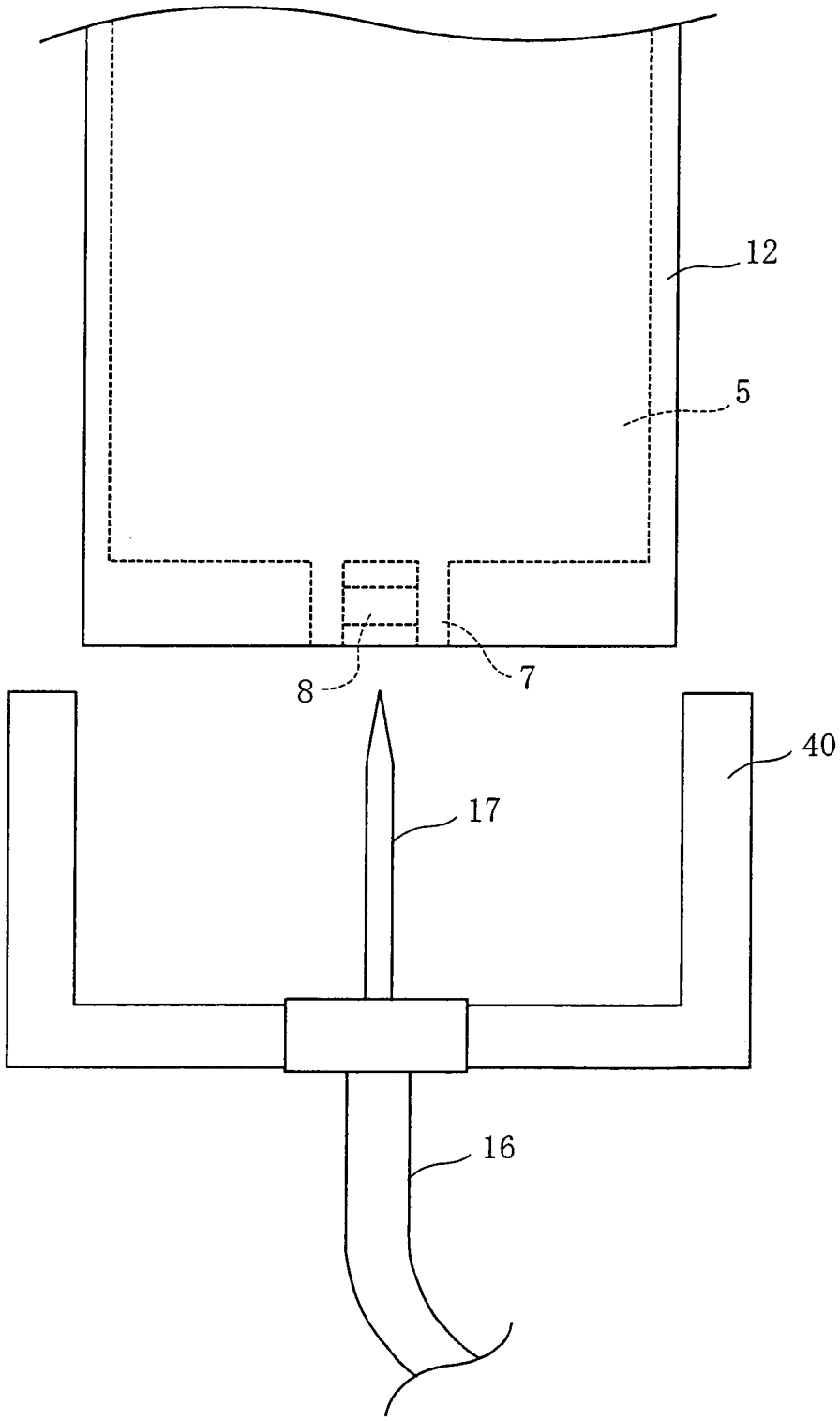
FIG. 2 is an enlarged view showing an ink package and a mounting portion of the apparatus of FIG. 1 on which the ink package is mounted.

FIG. 1 shows an ink-jet recording apparatus 100 and FIG. 2 shows an ink package 2 before it is mounted on the apparatus 100. The ink-jet recording apparatus 100 includes an ink-jet printing head 36 having nozzles through which ink is ejected to a recording medium, the ink package 2 accommodating the ink to be introduced into the ink-jet printing head 36, a mounting portion 40 on which the ink package 2 is removably mounted, tubes 16, 33 through which the ink accommodated in the ink package 2 that is mounted on the mounting portion 40 is introduced into the ink-jet printing head 36, a sub tank 31 and a buffer tank 24 in which the air bubbles contained in the stored ink is removed, and a suction device 60 in the form of a purge device for restoring the ink-ejecting performance of the ink-jet printing head 36.

The ink-jet printing head 36, the sub tank 31, the buffer tank 24, the suction device 60, etc., have respective constructions similar to those disclosed in JP-A-2001-260389, which is incorporated herein by reference, in its entirety.

The ink package 2 used on the ink-jet recording apparatus 100 is classified into two kinds depending upon how it is packed or enclosed before mounting on the mounting portion of the apparatus: an initial-use ink package and a replacement ink package. The initial-use ink package accommodates ink that is to be initially introduced into the ink-jet printing head 36 when the ink-jet printing head 36 is initially used. The replacement ink package accommodates ink that is to be introduced into the ink-jet printing head 36 into which the ink in the initial-use ink package has been already introduced.

The ink accommodated in the initial-use ink package and the ink accommodated in the replacement ink package have degrees of deaeration which are substantially equal to each other when the respective ink packages are manufactured. While the initial-use ink package is enclosed in a manner different from that in which the replacement ink package is enclosed for the purpose of preventing deterioration of the degree of deaeration before its use on the ink-jet recording apparatus, the initial-use ink package and the replacement ink package are substantially equal in construction to each other.

Figure 5:
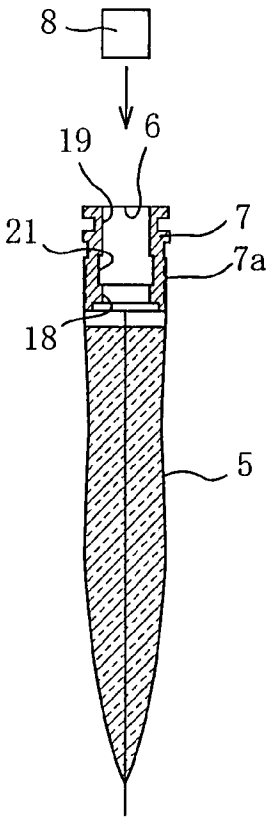
FIG. 5 is a cross sectional view taken along line 5-5 of FIG. 4.

There will be described a structure of the ink package 2 by referring to the exploded perspective view of FIG. 3, the front view of FIG. 4, and the cross sectional view of FIG. 5, without distinguishing the initial-use ink package and the replacement ink package from each other for the reasons described above.

The ink package 2 includes a flexible ink bag 5 accommodating a suitable volume of ink, and a rigid ink-bag casing 12 accommodating the ink bag 5. The ink bag 5 is formed from two sheets each in the form of a laminar structure consisting of a plurality of films superposed on each other. The two sheets are superposed on each other and welded together along their peripheries, except a non-welded portion of the periphery of each sheet, such that the two sheets are formed into the ink bag 5 having an opening 5*a* corresponding to the above-indicated non-welded portion, as shown in FIG. 4. The ink bag 5 is filled with deaerated or degassed ink. The ink bag 5 is provided with a spout 7 welded at its outer circumferential surface to the inner surface of the opening 5*a*, as also shown in FIG. 4. The spout 7 has a passage 6 for communication between an interior space and an exterior space of the ink bag 5. The spout 7 is arranged such that a closure member in the form of a plug 8 is press-fitted in the spout 7, so as to close the passage 6, that is, to fluid-tightly isolate the interior and exterior spaces of the ink bag 5.

Each of the two sheets used for the ink bag 5 is a laminar structure consisting of an intermediate layer of an aluminum alloy; a first adhesive layer formed on one of opposite surfaces of the aluminum alloy intermediate layer; an outer layer of nylon formed on the first adhesive layer; a second adhesive layer formed on the other surface of the aluminum alloy intermediate layer; a layer of polyethylene terephthalate (PET) formed on the second adhesive layer; a third adhesive layer formed on the PET layer; and an inner layer of polypropylene formed on the third adhesive layer. The ink bag 5 formed from the laminar sheets described above has a high degree of durability. In particular, the inner layer of polypropylene enables the ink bag 5 to exhibit a high degree of resistance to the ink contained in the ink bag 5, while the aluminum alloy intermediate layer prevents permeation of gases through the ink bag 5, for thereby preventing deterioration of the degree of deaeration of the ink.

The spout 7 welded to the opening 5*a* of the ink bag 5 takes the form of a sleeve member or a hollow cylindrical member formed of a material whose major component is polypropylene having a high degree of resistance to the ink. Namely, the major component of the material of the spout 7 is the same as the material of the inner layer of the ink bag 5, so that a plurality of ribs 7*a* formed integrally on the outer circumferential surface of the spout 7 can be firmly fixed to the inner surface of the opening 5*a* of the ink bag 5, so as to prevent a flow of gases into the ink bag 5 through the welded portion between the ink bag 5 and the spout 7, for thereby preventing deterioration of the degree of deaeration of the ink within the ink bag 5. The passage 6 formed through the spout 7 has an intermediate space 21 formed between opposite end portions 18, 19 of the passage 6. This space 21 has a larger inside diameter than those of the opposite end portions 18, 19, and is arranged to receive the plug 8.

The plug 8 is formed of a butyl rubber or similar material having a high degree of elasticity or resiliency that assures a sufficient degree of fluid tightness of the ink bag 5 even after an ink-outlet needle 17 (which will be described) that has pierced the plug 8 is removed from the plug 8. As indicated above, the plug 8 is press-fitted in the space 21 of the passage 6 of the spout 7. When the plug 8 is pierced with the ink-outlet needle 17, the inner end portion 18 of the passage 6 prevents a displacement of the plug 8 toward the inner open end of the spout 7 (toward the interior space of the ink bag 5). When the ink-outlet needle 17 is removed from the plug 8, the outer end portion 19 of the passage 6 prevents a displacement of the plug 8 toward the outer open end of the spout 7 (toward the exterior space of the ink bag 5).

Figure 3:
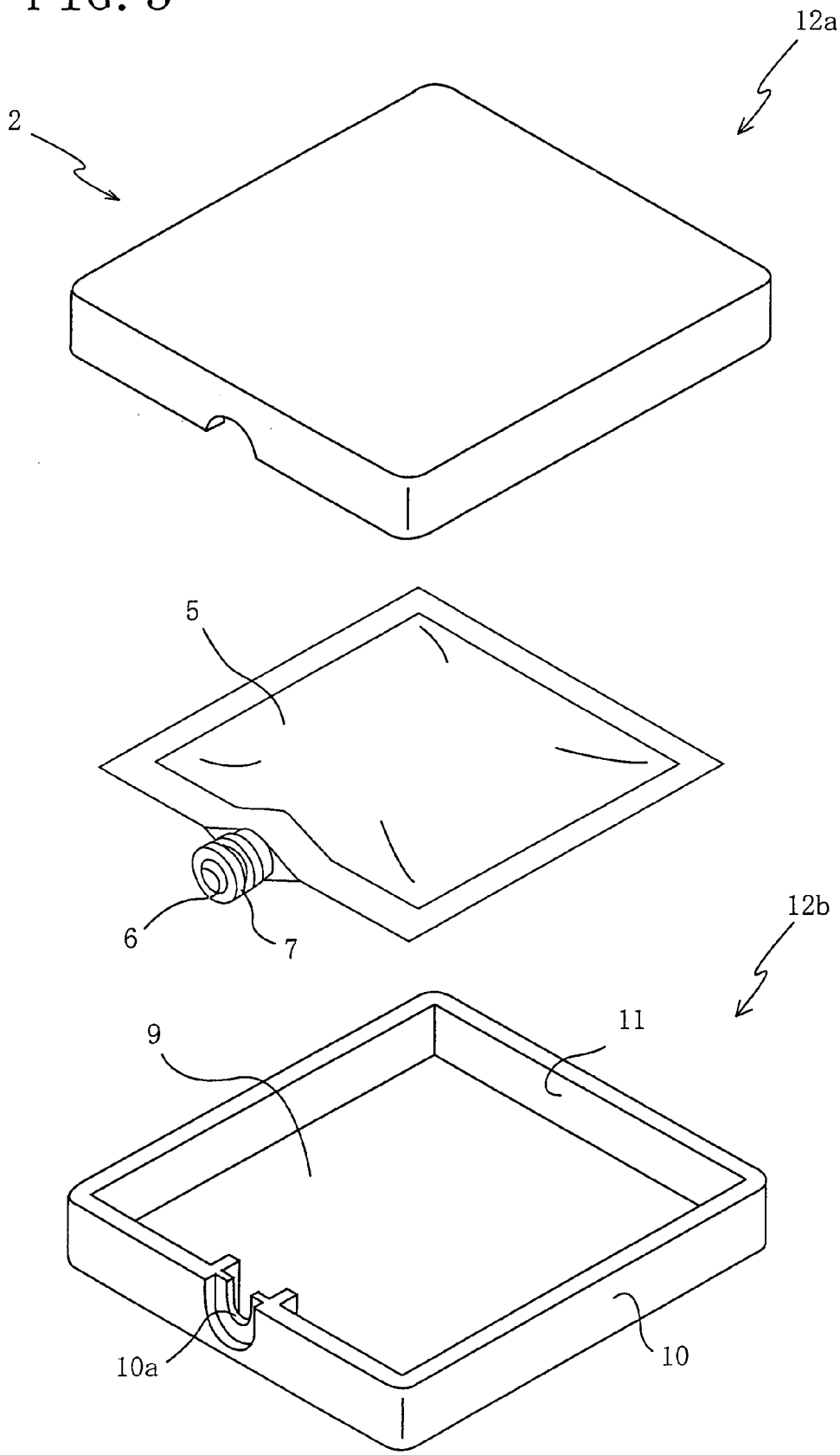
FIG. 3 is an exploded perspective view of the ink package.
Figure 4:
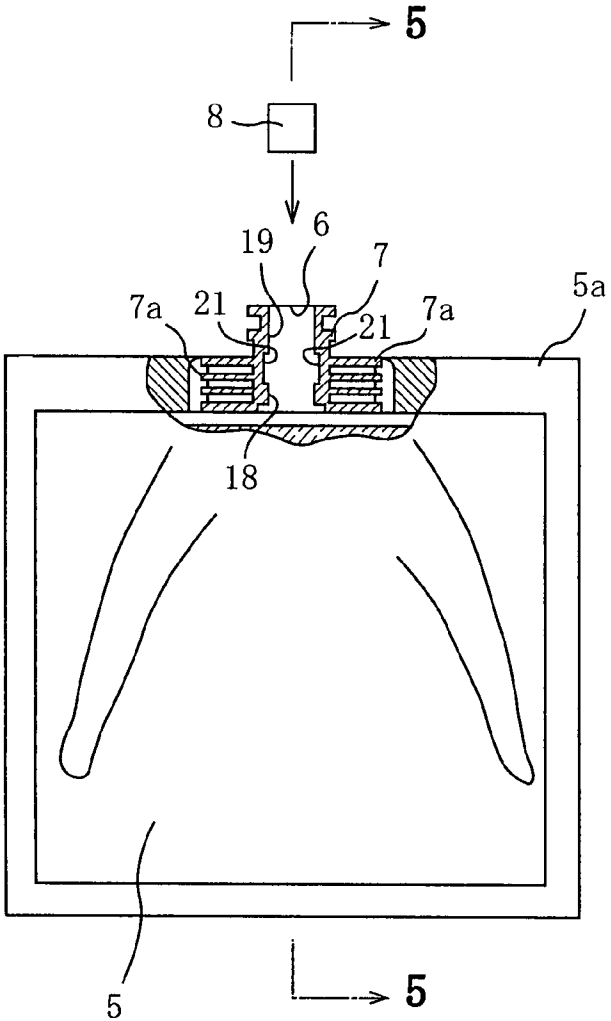
FIG. 4 is a front view partly in cross section of an ink bag of the ink package.

As shown in FIG. 3, the ink-bag casing 12 accommodating the thus constructed ink bag 5 includes an upper member 12*a* and a lower member 12*b*, which have substantially the same construction. Each of the upper and lower members 12*a*, 12*b* has a bottom wall 9, and four side walls 10 extending from respective four side edges of the bottom wall 9. The upper and lower members 12*a*, 12*b* are butted together at the end faces of the four side walls 10, so as to define an interior space 11 in which the ink bag 5 is accommodated such that the opposite major surfaces of the ink bag 5 in a generally flattened shape are opposed to the opposed bottom walls 9.

The bottom wall 9 of each of the upper and lower members 12*a*, 12*b* of the ink-bag casing 12 has an inner surface which is substantially equal in size with the opposite major surfaces of the ink bag 5. One of the four side walls 10 of each of the upper and lower members 12*a*, 12*b* has a cutout 10*a*, so that the cutouts 10*a* of the two members 12*a*, 12*b* cooperate to define a substantially circular aperture in which the outer end portion of the spout 7 is fixedly fitted such that the plug 8 fitted in the passage 6 of the spout 7 is accessible through the aperture formed through the corresponding side walls 10 of the upper and lower members 12*a*, 12*b*.

Figure 6:
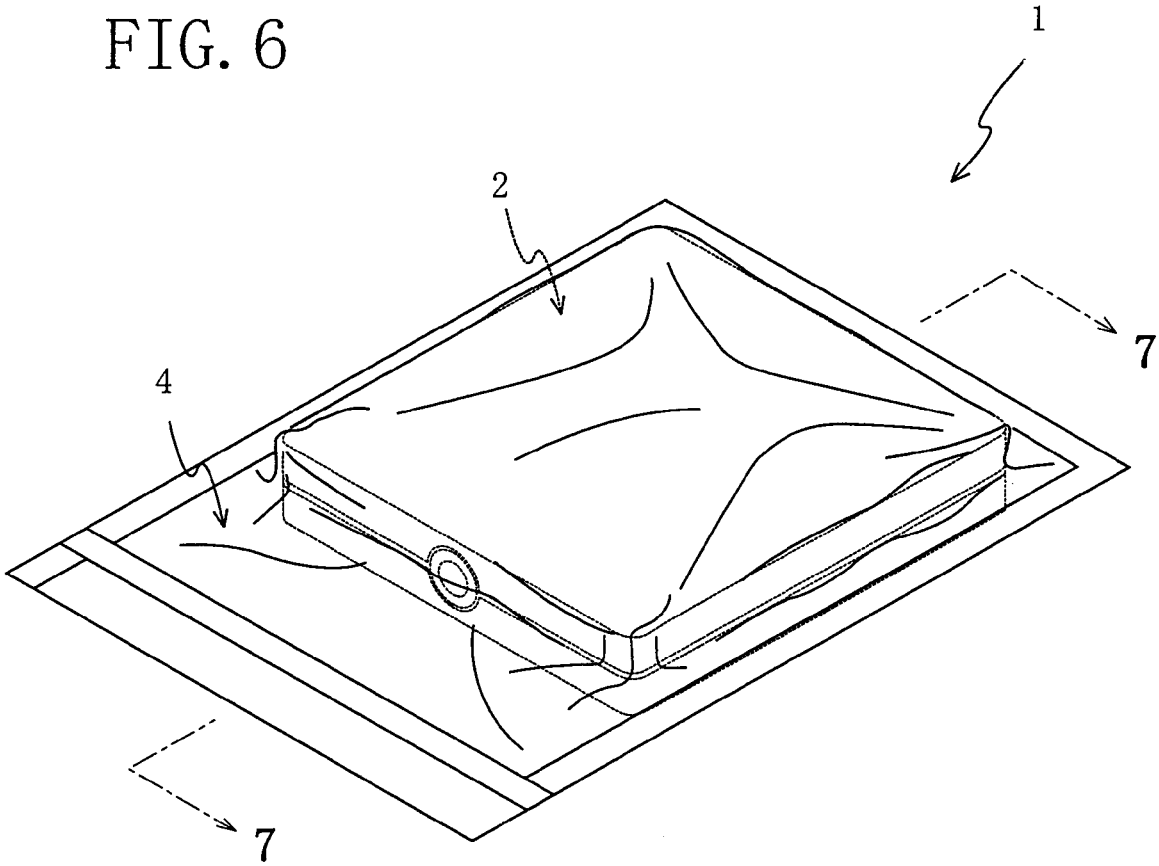
FIG. 6 is a perspective view of an ink-package assembly including an initial-use ink package and a sealing wrapper, constructed according to one embodiment of the present invention.
Figure 7:
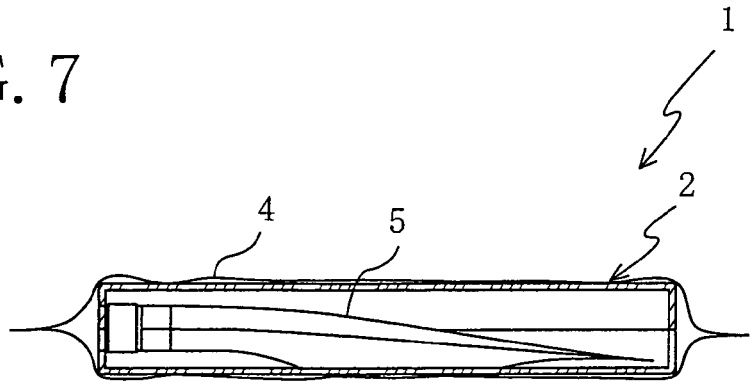
FIG. 7 is an elevational view in cross section taken along line 7-7 of FIG. 6.

Referring next to the perspective view of FIG. 6 and the elevational view of FIG. 7, there will be described a packaging arrangement of the thus constructed ink package 2 in the form of the initial-use ink package, according to a first embodiment of the present invention. As explained above, the initial-use ink package is packed or enclosed in a manner different from that in which the replacement ink package is packed or enclosed. In FIG. 6, the reference numeral 1 denotes an ink-package assembly including the initial-use ink package and a sealing wrapper 4 in the form of a closed bag fluid-tightly enclosing or covering the initial-use ink package 2. The initial-use ink package is enclosed or accommodated in the sealing wrapper 4 an interior space of which is evacuated to a reduced pressure lower than an atmospheric pressure. The replacement ink package not shown is packed or enclosed in a sealing wrapper an interior space of which is not kept at a reduced pressure, that is, the interior space of the sealing wrapper in which the replacement ink package is enclosed is kept at a pressure substantially equal to the atmospheric pressure. Alternatively, the replacement ink package may be simply wrapped. Further, the replacement ink package may not be enclosed in any wrapper.

Figure 8:
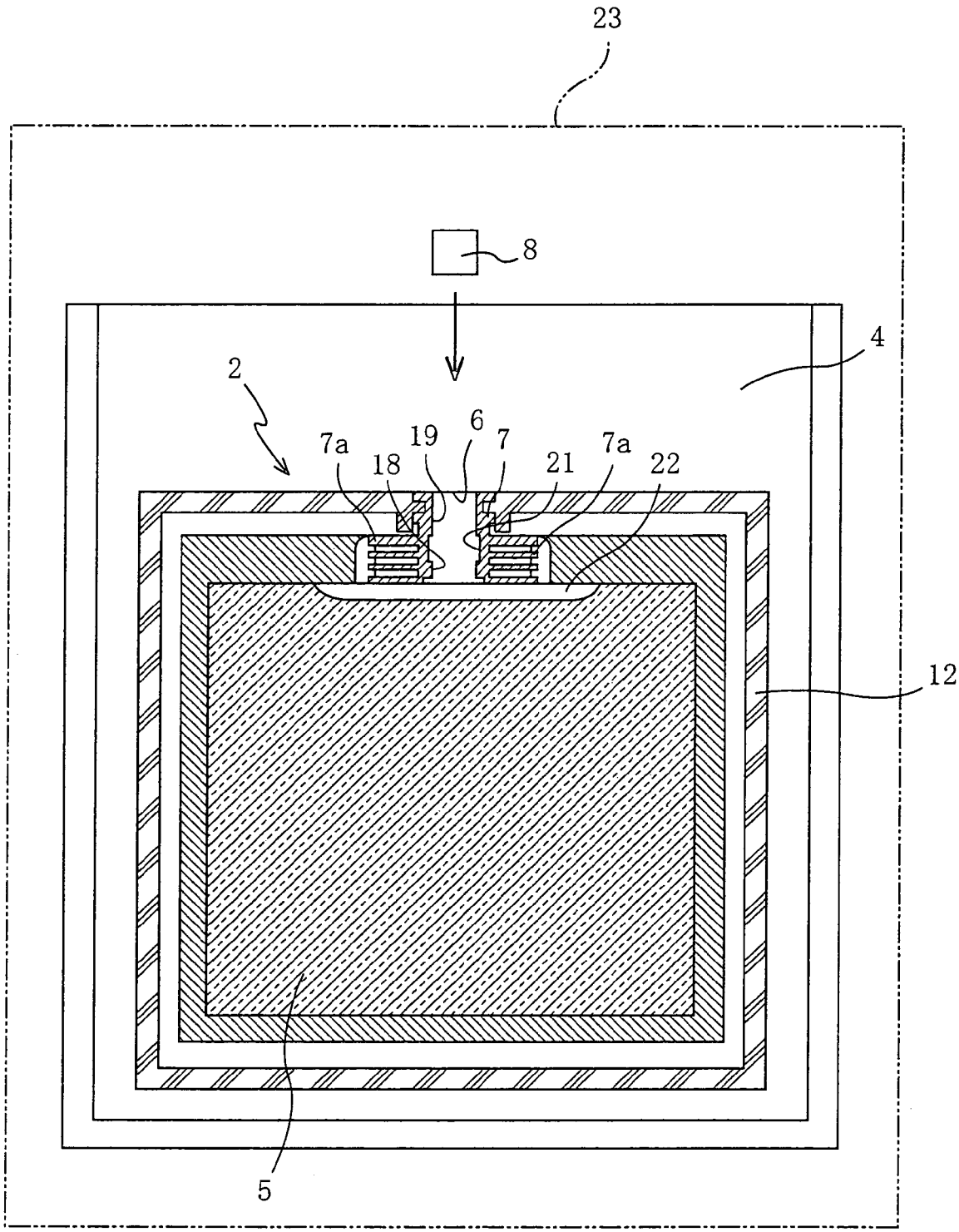
FIG. 8 is a view for explaining a method of enclosing the initial-use ink package in the sealing wrapper.

Referring next to FIG. 8, there will be described a method of packing or enclosing the initial-use ink package constructed as described above. Initially, the ink bag 5 accommodated in the ink-bag casing 12 is charged with the ink through the passage 6 of the spout 7. In charging the ink bag 5 with the ink, the ink bag 5 is not completely filled with the ink, that is, the ink bag 5 is charged such that the passage 6 of the spout 7 is not filled with the ink, in order to avoid poor tightness between the inner surface of the passage 6 and the outer surface of the plug 8 press-fitted in the passage 6, which would be caused in the presence of ink adhering to the inner surface of the passage 6. In this manner of charging the ink bag 5 with the ink, the ink bag 5 has a cavity 22 not filled with the ink, at a portion of its interior space adjacent to the lower open end of the spout 7, as shown in FIG. 8.

The ink package 2 which includes the ink-bag casing 12 accommodating the ink bag 5 is accommodated in the sealing wrapper 4, before the plug 8 is press-fitted in the passage 6 of the spout 7. The ink package 2 enclosed in the sealing wrapper 4 is then placed in a chamber 23 which is kept at a reduced pressure lower than the atmospheric pressure (about −40 kPa), in an open state of the sealing wrapper 4, so that the cavity 22 within the ink bag 5 and the interior space of the sealing wrapper 4 are kept exposed to the reduced pressure. Then, the plug 8 is press-fitted in the passage 6 of the spout 7, and the opening of the sealing wrapper 4 is fluid-tightly closed by a thermal welding operation, while the ink package 2 is kept in the chamber 23. The sealing wrapper 4 is formed from two sheets each in the form of a laminar structure, which does not permit permeation of gases therethrough, like the two sheets used for the ink bag 5 described above.

As described above, the initial-use ink package is enclosed in the sealing wrapper whose interior space is kept at the reduced pressure, so that the ink in the initial-use ink package is kept in a highly deaerated or degassed state before its use on the recording apparatus. In the replacement ink package which is not exposed to the reduced pressure or which is kept at the atmospheric pressure, however, the air inevitably permeates through the ink bag 5 and is dissolved in the ink accommodated in the replacement ink package, before its use on the recording apparatus. Accordingly, the ink in the initial-use ink package and the ink in the replacement ink package which have degrees of deaeration substantially equal to each other upon manufacture have respective different degrees of deaeration upon use on the recording apparatus. Namely, the degree of deaeration of the ink in the initial-use ink package is higher than that of the ink in the replacement ink package upon use on the recording apparatus.

In general, the initial-use ink package is delivered or shipped such that the initial-use ink package is packed together with the ink-jet recording apparatus while the replacement ink package is delivered or shipped as a supply or replenishment to be purchased by users of the recording apparatus. The initial-use ink package and the replacement ink package may be delivered or shipped such that both of the initial-use ink package and the replacement ink package are packed together with the ink-jet recording apparatus. Further, the initial-use ink package and the replacement ink package may be delivered or shipped in the form of an ink-package set in which at least one initial-use ink package and at least one replacement ink package are packed together.

As described above, the inventor of the present invention conducted experiments and found that the ink-ejecting performance of the ink-jet recording apparatus is largely influenced by the degree of deaeration of the ink in a case where the ink is initially introduced into the ink-jet printing head of the ink-jet recording apparatus when the ink-jet printing head is initially used. As long as the ink having a relatively high degree of deaeration is introduced when the ink-jet printing head is initially used, the ink-ejecting performance of the recording apparatus is not largely influenced by the degree of deaeration of the ink which is to be subsequently introduced. Judging from the above findings, it is not necessary to enclose all of the ink packages including the replacement ink package, such that the ink in the ink packages is kept in the highly deaerated or degassed state. As long as the initial-use ink package is enclosed such that the ink accommodated therein does not suffer from deterioration of the degree of deaeration, the ink-jet printing head is capable of exhibiting its ink-ejecting performance with high stability.

There will be next explained a method of introducing ink in the ink-jet recording apparatus 100. In introducing the ink into the ink-jet printing head 36 when the ink-jet printing head 36 is initially used, the initial-use ink package enclosed in the sealing wrapper as described above is taken out of the sealing wrapper 4. Then, the initial-use ink package is mounted on the mounting portion 40 of the ink-jet recording apparatus 100 while it is moved along a guide (not shown) provided on the mounting portion 40. The initial-use ink package is preferably taken out of the sealing wrapper immediately before it is mounted on the mounting portion 40. Where the initial-use ink package is enclosed in the sealing wrapper such that the inner surface of the sealing wrapper is in close contact with the outer surface of the initial-use ink package, the initial-use ink package may be mounted on the mounting portion such that at least a part of the initial-use ink package is exposed to an exterior space of the sealing wrapper, without taking the ink package out of the sealing wrapper.

When the initial-use ink package is mounted on the mounting portion 40, the plug 8 is pierced with the ink-outlet needle 17, such that the free end portion of the needle 17 is located within the ink bag 5. The ink-outlet needle 17 is connected to the sub tank 31 via the tube 16, so that the ink in the ink bag 5 of the initial-use ink package is supplied, via the needle 17 and the tube 16, to the sub tank 31 by the pump 30 under control of control means 70. The upper portion of the sub tank 31 is open to the atmosphere through a tube 32.

When the ink is supplied to the sub tank 31, the control means 70 controls a suction cap 61 to fluid-tightly close all of the nozzles of the ink-jet printing head 36, and a pump 38 for air bleeding is actuated under control of the control means 70, so that the ink in the sub tank 31 is supplied to the buffer tank 24 via the tube 33.

When the ink supplied from the sub tank 31 is stored in the buffer tank 24, a suction pump 62 of the suction device 60 is actuated under control of the control means 70, and the ink in the buffer tank 24 is introduced into the ink-jet printing head 36. The ink which is to be initially introduced into the ink-jet printing head 36 when the ink-jet printing head 36 is initially used is accommodated in the initial-use ink package and has a comparatively high degree of deaeration, so that the ink is less likely to be bubbled by contact with the inner wall surfaces of the channels in the ink-jet printing head 36 and by turbulence flows of the ink which may be produced at corners of the channels. Accordingly, the ink introduced into the ink-jet printing head 36 can be ejected therefrom with high stability.

When the ink in the initial-use ink package is substantially consumed, notifying means (not shown) notifies the user of a need to replace the ink package with a new one. Upon notification, the initial-use ink package is removed from the mounting portion 40, and the replacement ink package is mounted on the mounting portion 40. Thus, the ink in the replacement ink package which has replaced the initial-use ink package is introduced into the ink-jet printing head 36.

The ink which is to be subsequently introduced into the ink-jet printing head 36 into which the ink accommodated in the initial-use ink package has been already introduced has a degree of deaeration lower than that of the initially introduced ink. Since the fluid passage between the ink package 2 and the ink-jet printing head 36 is filled with the initially introduced ink or the inner surface of the fluid passage is covered with the ink, the ink which is subsequently introduced into the ink-jet printing head 36 is less likely to be bubbled. Accordingly, the ink-ejecting performance of the ink-jet printing head is not largely influenced by the degree of deaeration of the ink that is subsequently introduced into the ink-jet printing head into which the ink has been already introduced. Therefore, the ink-jet printing head 36 exhibits good ink-ejecting performance with high stability even if the ink whose degree of deaeration is lower than that of the initially introduced ink is supplied to the ink-jet printing head 36.

Within the buffer tank 24, the air which has permeated into the ink through the wall of the tube 33 is separated from the ink owing to a difference of the specific gravity between the air and the ink, and is discharged when appropriate by the pump 38 through a tube 37 connected to the buffer tank 24.

Referring next to the perspective view of FIG. 9 and the elevational view of FIG. 10, there will be described a packaging arrangement of the initial-use ink package according to a second embodiment of the present invention. According to this second embodiment, the initial-use ink package is packed or enclosed in the sealing wrapper 4 an interior space of which is charged with an inert gas in the form of a helium gas. Where the helium gas is used as the inert gas charging the interior space of the sealing wrapper, the cost required for packing the initial-use ink package is relatively low.

In this second embodiment, the initial-use ink package is enclosed in the sealing wrapper 4 which is charged with the helium gas having a lower degree of solubility in the ink than the air. Accordingly, an amount of the helium gas which permeates through the ink package and which is dissolved in the ink is smaller than an amount of the air which would be dissolved in the ink, so that the degree of deaeration of the ink accommodated in the initial-use ink package is prevented from being lowered. Thus, the ink accommodated in the initial-use ink package can be kept in a highly deaerated state. Therefore, where the ink in the initial-use ink package is initially introduced into the ink-jet printing head when the ink-jet printing head is initially used, the ink is prevented from being bubbled in the ink-jet printing head.

There will be described a method of packing or enclosing the initial-use ink package according to the second embodiment. In a manner similar to that described above with respect to the above-described first embodiment, the ink bag 5 is charged with the ink, the ink-bag casing 12 accommodating the ink bag 5 charged with the ink is enclosed in the sealing wrapper 4, and the sealing wrapper 4 is placed in the chamber 23, so that the cavity 22 within the ink bag 5 and the interior space of the sealing wrapper 4 are kept exposed to a reduced pressure. In this second embodiment, the chamber 23 is filled with a helium gas, and the cavity 22 of the ink bag 5 and the interior space of the sealing wrapper 4 are evacuated to a pressure lower than the atmospheric pressure (about −40 kPa) within the chamber 23 filled with the helium gas, for thereby charging the cavity 22 and the interior space of the sealing wrapper 4 with the helium gas. Thereafter, as in the above-described first embodiment, the plug 8 is press-fitted in the passage 6 of the spout 7, and the opening of the sealing wrapper 4 is fluid-tightly closed by a thermal welding operation.

As described above with respect to the first embodiment, the ink accommodated in the initial-use ink package and the ink accommodated in the replacement ink package have degrees of deaeration substantially equal to each other upon manufacture. Since the initial-use ink package is enclosed in the sealing wrapper such that the ink accommodated in the initial-use ink package is kept in a highly deaerated state, the ink accommodated in the initial-use ink package has a degree of deaeration higher than that of the ink accommodated in the replacement ink package upon use on the recording apparatus. The ink in the initial-use ink package constructed according to the second embodiment is introduced into the ink-jet printing head 36 in a manner similar to that described above with respect to the first embodiment.

While the preferred embodiments of the present invention have been described above, for illustrative purpose only, it is to be understood that the invention is not limited to the details of the illustrated embodiments, but may be embodied with various changes, modifications and improvements, which may occur to those skilled in the art, without departing from the spirit and scope of the invention defined in the attached claims.

Figure 11:
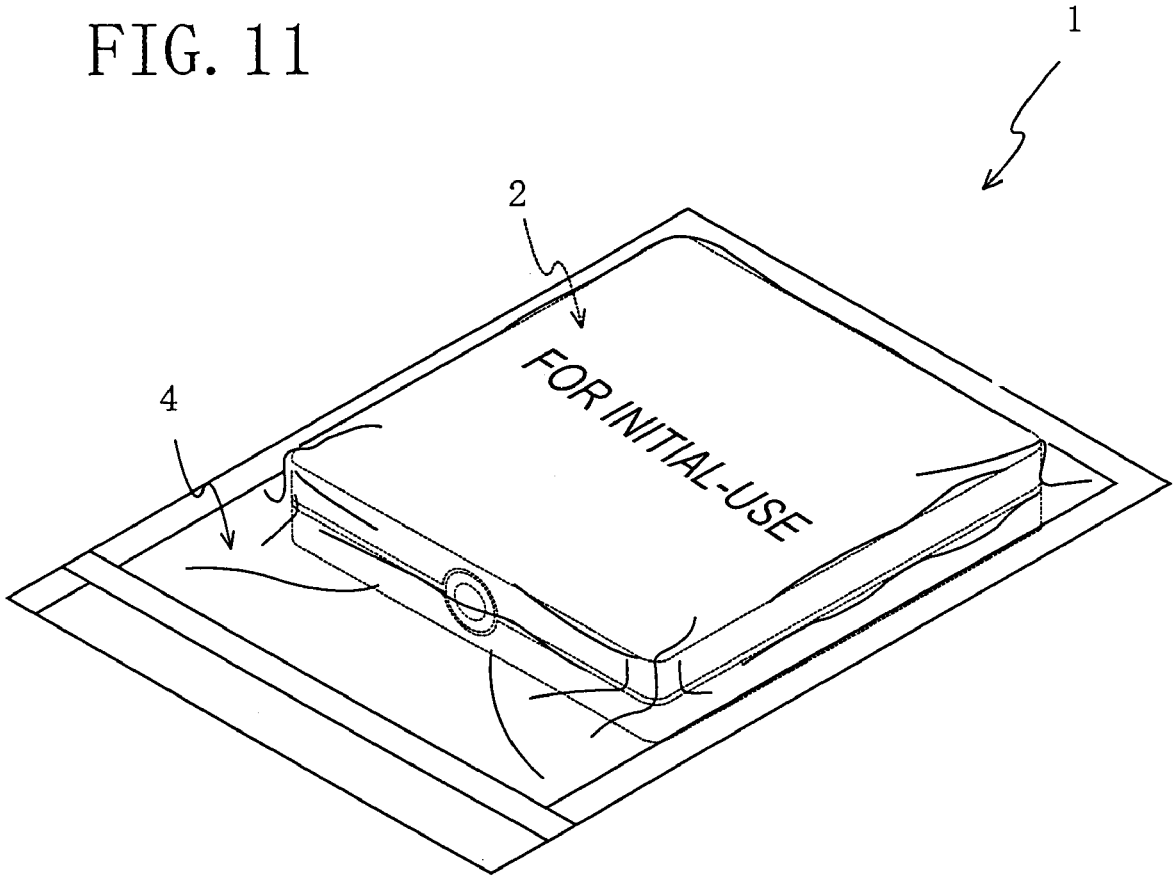
FIG. 11 is a perspective view of an ink-package assembly including an initial-use ink package and a sealing wrapper, constructed according to still another embodiment of the invention.
Figure 12:
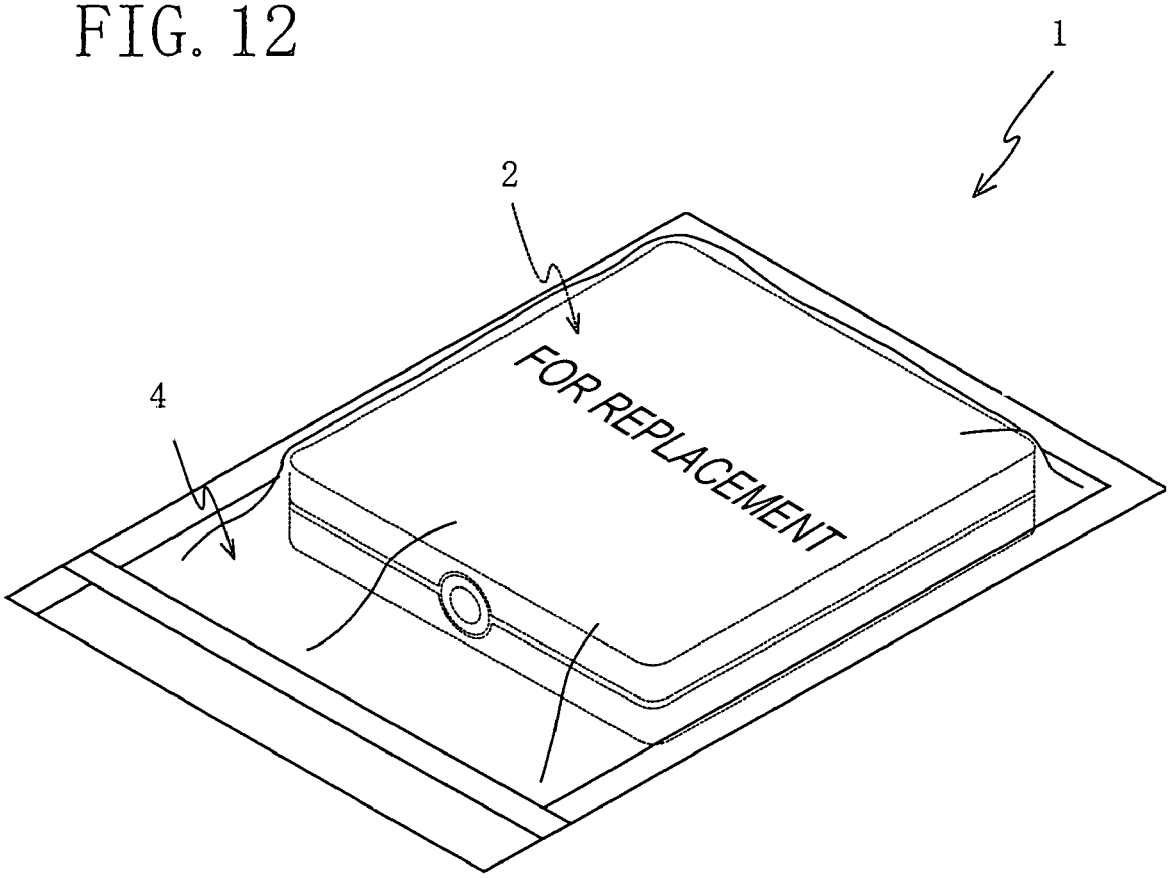
FIG. 12 is a perspective view of an ink-package assembly including a replacement ink package and a sealing wrapper, constructed according to yet another embodiment of the invention.
Figure 13:
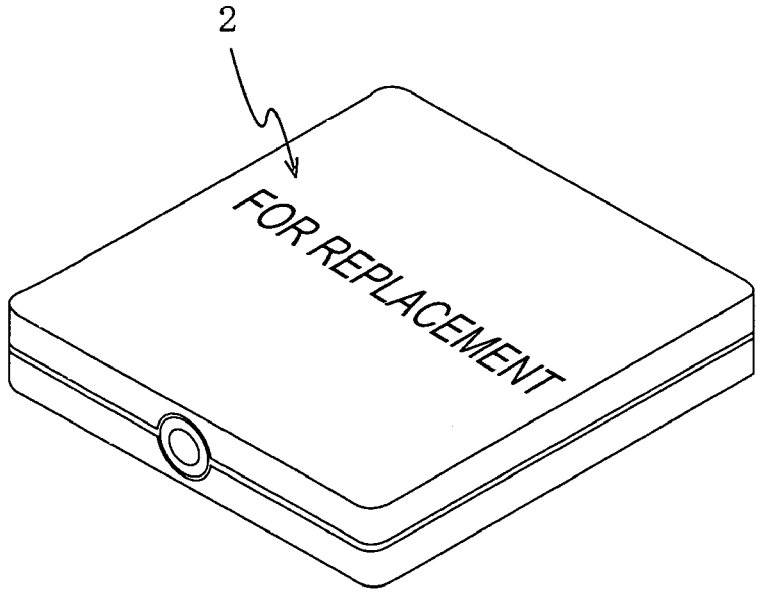
FIG. 13 is a perspective view of a replacement ink package constructed according to a further embodiment of the invention.

For instance, the ink-package assembly 1 which includes the ink package 2 and the sealing wrapper 4 enclosing the ink package 2 may be otherwise constructed. Described more specifically by referring to FIG. 11, the ink-package assembly 1 including the sealing wrapper 4 an interior space of which is evacuated to the reduced pressure as described above with respect to the first embodiment or charged with the inert gas as described above with respect to the second embodiment, may have an indication that the ink package 2 is the initial-use ink package. Similarly, as shown in FIG. 12, the ink-package assembly 1 including the sealing wrapper 4 an interior space of which is kept at an atmospheric pressure may have an indication that the ink package 2 is the replacement ink package. Alternatively, the ink package 2 may not be enclosed in any sealing wrapper and may have an indication that the ink package 2 is the replacement ink package, as shown in FIG. 13.

Figure 9:
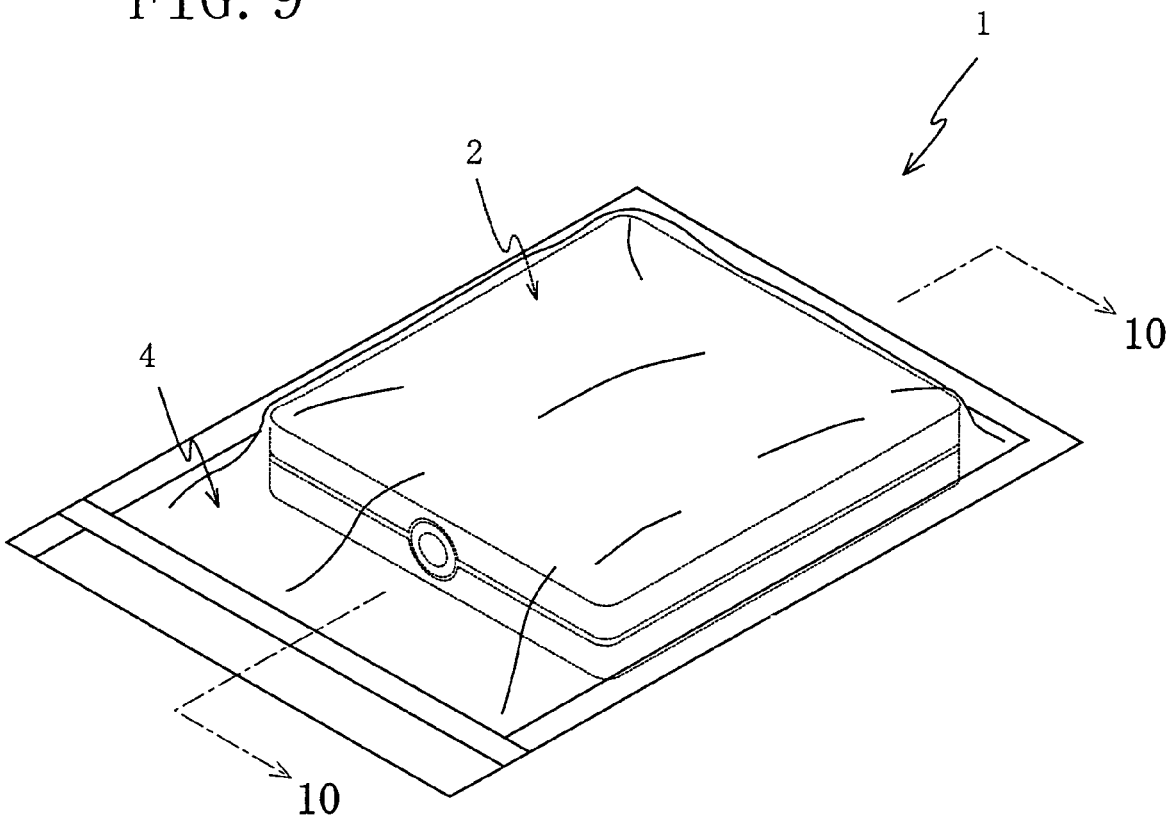
FIG. 9 is a perspective view of an ink-package assembly including an initial-use ink package and a sealing wrapper, constructed according to another embodiment of the invention.
Figure 10:
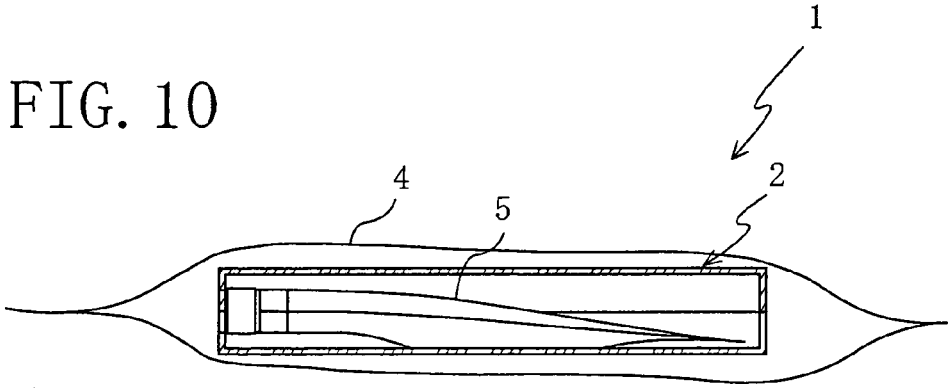
FIG. 10 is an elevational view in cross section taken along line 10-10 of FIG. 9.

In the above-described second embodiment of FIGS. 9 and 10, the cavity 22 in the ink bag 5 is filled with the helium gas when the interior space of the sealing wrapper 4 is charged with the helium gas. However, the cavity 22 in the ink bag 5 may be evacuated to a reduced pressure lower than the atmospheric pressure while the interior space of the sealing wrapper is charged with the helium gas, by first press-fitting the plug 8 in the passage 6 of the spout 7 and then filling the chamber 23 with the helium gas. The initial-use ink package may be packed or enclosed as described above.

What is claimed is:

1. A method of introducing ink in an ink-jet recording apparatus comprising an ink-jet printing head which ejects, to a recording medium, the ink through nozzles thereof, wherein said apparatus includes a mounting portion on which an ink package accommodating the ink is removably mounted, and an ink-introducing device which introduces, into said ink-jet printing head, the ink accommodated in said ink package that is mounted on said mounting portion, said method comprising the steps of:

a first ink-introducing step of initially introducing a first ink having a first degree of deaeration, into said ink-jet printing head when said ink-jet printing head is initially used, said first ink-introducing step comprising (a) mounting, as said ink package, an initial-use ink package accommodating said first ink, on said mounting portion and (b) introducing said first ink into said ink-jet printing head by said ink-introducing device; and a second ink-introducing step of subsequently introducing a second ink having a second degree of dearation lower than said first degree of deaeration, into said ink-jet printing head after said first ink-introducing step, said second ink-introducing step comprising (a) mounting, as said ink package, a replacement ink package accommodating said second ink, on said mounting portion, for replacing said ink package which has been mounted on said mounting portion immediately before said replacement ink package is mounted, and (b) introducing said second ink into said ink-jet printing head by said ink-introducing device; and wherein said initial-use ink package is in a state, before mounting thereof on said mounting portion, in which said initial-use ink package is enclosed such that said first ink in said initial-use ink package maintains said first degree of deaeration which is higher than said second degree of deaeration of said second ink in said replacement ink package.

2. The method according to claim 1, wherein said initial-use ink package is in a state, before mounting thereof on said mounting portion, in which said initial-use ink package is enclosed in a sealing wrapper whose interior space is evacuated to a pressure lower than an atmospheric pressure.

3. The method according to claim 2, wherein said first-ink introducing step further comprises a step of taking said initial-use ink package out of said sealing wrapper before mounting on said mounting portion.

4. The method according to claim 1, wherein said initial-use ink package is in a state, before mounting thereof on said mounting portion, in which said initial-use ink package is enclosed in a sealing wrapper whose interior space is charged with an inert gas that has a degree of solubility in the ink lower than the air.

5. The method according to claim 4, wherein said first-ink introducing step further comprises a step of taking said initial-use ink package out of said sealing wrapper before mounting on said mounting portion.

6. The method according to claim 4, wherein said inert gas is a helium gas.

7. The method according to claim 1, wherein each of said initial-use ink package and said replacement ink package includes an ink bag whose opposite major surfaces are constituted by a pair of flexible walls, and a rigid ink-bag casing which accommodates said ink bag.

8. An ink-jet recording apparatus comprising an ink-jet printing head having nozzles through which ink is ejected to a recording medium, an ink package in which the ink that is to be introduced into said ink-jet printing head is accommodated, a mounting portion on which said ink package is removably mounted, and an ink-introducing device which introduces, into said ink-jet printing head, the ink that is accommodated in said ink package mounted on said mounting portion, wherein said ink package comprises an initial-use ink package accommodating a first ink having a first degree of deaeration and a replacement ink package accommodating a second ink having a second degree of deaeration which is lower than said first degree of deaeration, said initial-use ink package and said replacement ink package being selectively mounted on said mounting portion, said initial-use ink package being initially mounted on said mounting portion when said ink-jet printing head is initially used.

9. The ink-jet recording apparatus according to claim 8, wherein said initial-use ink package is in a state, before mounting thereof on said mounting portion, in which said initial-use ink package is enclosed such that said first ink in said initial-use ink package maintains said first degree of deaeration which is higher than said second degree of deaeration of said second ink in said replacement ink package.

10. The ink-jet recording apparatus according to claim 9, wherein said initial-use ink package is in a state, before mounting thereof on said mounting portion, in which said initial-use ink package is enclosed in a sealing wrapper whose interior space is evacuated to a pressure lower than an atmospheric pressure.

11. The ink-jet recording apparatus according to claim 9, wherein said initial-use ink package is in a state, before mounting thereof on said mounting portion, in which said initial-use ink package is enclosed in a sealing wrapper whose interior space is charged with an inert gas that has a degree of solubility in the ink lower than the air.

12. The ink-jet recording apparatus according to claim 11, wherein said inert gas is a helium gas.

13. The ink-jet recording apparatus according to claim 8, wherein each of said initial-use ink package and said replacement ink package includes an ink bag whose opposite major surfaces are constituted by a pair of flexible walls, and a rigid ink-bag casing which accommodates said ink bag.

* * * * *